US011005169B2

(12) United States Patent
Shepeleva et al.

(10) Patent No.: US 11,005,169 B2
(45) Date of Patent: May 11, 2021

(54) ANTENNA AND WIRELESS COMMUNICATION DEVICE INCLUDING ANTENNA

(71) Applicant: Samsung Electronics Co., Ltd., Suwon-si (KR)

(72) Inventors: Elena Aleksandrovna Shepeleva, Kostroma (RU); Gennadiy Aleksandrovich Evtyushkin, Moscow (RU); Anton Sergeevich Lukyanov, Moscow (RU); Artem Yurievich Nikishov, Kolomna Moscow (RU)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/616,767

(22) PCT Filed: May 25, 2018

(86) PCT No.: PCT/KR2018/005971
§ 371 (c)(1),
(2) Date: Nov. 25, 2019

(87) PCT Pub. No.: WO2018/217061
PCT Pub. Date: Nov. 29, 2018

(65) Prior Publication Data

US 2020/0106171 A1 Apr. 2, 2020

(30) Foreign Application Priority Data

May 25, 2017 (RU) ..... 2017118175

(51) Int. Cl.
*H01Q 13/10* (2006.01)
*H01Q 1/38* (2006.01)
(Continued)

(52) U.S. Cl.
CPC ..... *H01Q 1/38* (2013.01); *H01Q 9/0485* (2013.01); *H01Q 21/064* (2013.01); *H01Q 21/065* (2013.01); *H01Q 21/24* (2013.01)

(58) Field of Classification Search
CPC .... H01Q 21/064; H01Q 21/005; H01Q 13/10; H01Q 21/065; H01Q 1/38; H01Q 13/02;
(Continued)

(56) References Cited

U.S. PATENT DOCUMENTS 3,225,351 A 12/1965 Chatelain et al.
5,596,336 A * 1/1997 Liu ..... H01Q 13/10 343/700 MS
(Continued)

FOREIGN PATENT DOCUMENTS

CN 101901960 A 12/2010
CN 104752828 A 7/2015
(Continued)

OTHER PUBLICATIONS

European Search Report dated Mar. 20, 2020, issued in European Application No. 18805844.0.
(Continued)

*Primary Examiner* — Linh V Nguyen
(74) *Attorney, Agent, or Firm* — Jefferson IP Law, LLP

(57) ABSTRACT

The present disclosure relates to a 5G or pre-5G communication system for supporting a higher data transmission rate than a 4G system, such as LTE. Various embodiments of the present disclosure provide a device and a method. To this end, an antenna unit may comprise a dielectric substrate, a dielectric cover on the dielectric substrate, and a slot antenna array formed in a metal layer arranged on or in the dielectric substrate. The slot antenna array may be configured to generate a traveling wave which propagates in the dielectric substrate and the dielectric cover, and may have at least two
(Continued)

groups (first and second groups) of slot elements. Each slot element of the second group may be shorter than any slot element of the first group, and slots of the first and second groups may be arranged to be opposite to each other so as to make pairs of slot elements. In a pair of slot elements, the distance from the slot element of the first group to the slot element of the second group may be selected such that a phase shift is provided between 90 degree radiation waves thereof. The pairs of slot elements may be arranged out of alignment such that even-numbered pairs of slot elements are offset from odd-numbered pairs of slot elements.

14 Claims, 3 Drawing Sheets

(51) Int. Cl.
*H01Q 9/04* (2006.01)
*H01Q 21/06* (2006.01)
*H01Q 21/24* (2006.01)

(58) Field of Classification Search
CPC ..... H01Q 21/24; H01Q 1/243; H01Q 13/06; H01Q 13/106; H01Q 21/0012
USPC ..... 343/767, 768, 770, 771
See application file for complete search history.

(56) References Cited

U.S. PATENT DOCUMENTS

| | | | | |
|---|---|---|---|---|
| 6,124,833 | A * | 9/2000 | Bialkowski | H01Q 13/22 343/770 |
| 6,535,173 | B2 * | 3/2003 | Ou | H01Q 21/005 343/770 |
| 7,292,197 | B2 | 11/2007 | Goldberg et al. | |
| 8,134,514 | B2 * | 3/2012 | Yamaguchi | H01Q 13/203 343/770 |
| 8,669,904 | B2 | 3/2014 | Choi et al. | |
| 8,760,352 | B2 | 6/2014 | Rao et al. | |
| 9,136,608 | B2 * | 9/2015 | Yano | H01Q 21/064 |
| 10,020,591 | B2 * | 7/2018 | Uemichi | H01Q 13/22 |
| 10,498,019 | B2 * | 12/2019 | Ohtake | H01Q 1/38 |
| 2002/0101385 | A1 * | 8/2002 | Huor | H01Q 21/005 343/770 |
| 2008/0266195 | A1 * | 10/2008 | Yamaguchi | H01Q 21/0043 343/771 |
| 2009/0046025 | A1 * | 2/2009 | Gardner | H01Q 21/064 343/711 |
| 2009/0153410 | A1 | 6/2009 | Chiang et al. | |
| 2011/0012794 | A1 | 1/2011 | Schlub et al. | |
| 2011/0181482 | A1 | 7/2011 | Adams et al. | |
| 2015/0349428 | A1 | 12/2015 | Kashino et al. | |
| 2016/0126637 | A1 * | 5/2016 | Uemichi | H01Q 13/22 343/771 |

FOREIGN PATENT DOCUMENTS

| | | | |
|---|---|---|---|
| EP | 1 263 077 | A1 | 12/2002 |
| EP | 1 739 789 | A1 | 1/2007 |
| GB | 2 315 600 | A | 2/1998 |
| JP | 2015-231062 | A | 12/2015 |
| KR | 10-2001-0021105 | A | 3/2001 |
| KR | 10-0714636 | B1 | 5/2007 |
| KR | 10-2012-0044999 | A | 5/2012 |
| RU | 2 079 190 | C1 | 5/1997 |
| RU | 2010 100 683 | A | 7/2011 |
| WO | 99/56346 | A1 | 11/1999 |

OTHER PUBLICATIONS

Ohira et al., 60GHz Wideband Shaped-Beam Antenna Using Closely-Spaced Waveguide Slots for Wireless LAN, ATR Wave Engineering Laboratories, Kyoto, Japan.

* cited by examiner

ANTENNA AND WIRELESS COMMUNICATION DEVICE INCLUDING ANTENNA

CROSS-REFERENCE TO RELATED APPLICATION(S)

This application is a U.S. National Stage application under 35 U.S.C. § 371 of an International application number PCT/KR2018/005971, filed on May 25, 2018, which is based on and claimed priority of a Russian patent application number 2017118175, filed on May 25, 2017, in the Russian Intellectual Property Office, the disclosure of which is incorporated by reference herein in its entirety.

TECHNICAL FIELD

Various embodiments of the present disclosure relate to an antenna and a wireless communication device including the same in a wireless communication network.

BACKGROUND ART

To satisfy demands for wireless data traffic having increased since commercialization of $4^{th}$-Generation (4G) communication systems, efforts have been made to develop improved $5^{th}$-Generation (5G) communication systems or pre-5G communication systems. For this reason, the 5G communication system or the pre-5G communication system is also called a beyond-4G-network communication system or a post-Long Term Evolution (LTE) system.

It is considered that the 5G communication system will be implemented in millimeter wave (mmWave) bands, e.g., 60 GHz bands, so as to accomplish higher data rates. In the 5G communication system, beamforming, massive multi-input multi-output (MIMO), full dimensional MIMO (FD-MIMO), an array antenna, analog beamforming, and large-scale antenna technologies have been discussed to alleviate a propagation path loss and to increase a propagation distance in the ultra-high frequency band.

For system network improvement, in the 5G communication system, techniques such as an evolved small cell, an advanced small cell, a cloud radio access network (RAN), an ultra-dense network, a device to device (D2D) communication, a wireless backhaul, a moving network, cooperative communication, coordinated multi-points (CoMPs), and interference cancellation have been developed.

In the 5G system, advanced coding modulation (ACM) schemes including hybrid frequency-shift keying (FSK) and quadrature amplitude modulation (QAM) modulation (FQAM) and sliding window superposition coding (SWSC), and advanced access schemes including filter bank multi carrier (FBMC), non-orthogonal multiple access (NOMA), and sparse code multiple access (SCMA) have been developed.

DETAILED DESCRIPTION OF THE INVENTION

Technical Problem

The next generation standard should allow users to find desired information on the Internet using as little time as possible. For this reason, the $5^{th}$ generation standard operates at millimeter wavelengths.

U.S. Pat. No. 8,760,352 B2 (published on 2005 Oct. 4), which is a solution describing a mobile device and an antenna array thereof, discloses a low-profile antenna, which has interleaved TX/RX antenna elements, covering an end-fire (in the telephone's plane) and a broadside (perpendicular to the telephone's plane) direction. This solution cannot be implemented in a mobile device with a metal case as electromagnetic radiation is distorted by the metal case.

U.S. Pat. No. 3,225,351 (published on 1965 Dec. 21) relates to a vertically polarized microstrip antenna for a glide path system and discloses a traveling wave antenna array for guiding an airplane to a landing strip. This solution, though using a similar principle, cannot be implemented in mobile communication technology. This is because it does not use the capability of scanning a space, so it cannot be implemented with functioning capability in a mobile device with a metal frame. In addition, the size of the antenna in this solution is 2-3 wavelengths which is greater than in the developed solution.

An article of Masataka Ohira, Amane Miura И Masazumi Ueba, published on March 2007 in the journal "International Journal of Infrared and Millimeter Waves" is well known. This article describes a substrate integrated waveguide cavity which suppresses backward radiation and ensures the antenna has a very low profile (only about 4% of the operating wavelength). The article introduces several techniques, such as a slot resonator with a semicircular end and a quarter-wavelength microstrip resonator, to improve impedance matching. The studied results demonstrate that this antenna has wide operating bandwidth in 54.3-67 GHz, a narrow radiation pattern, and a low level of cross-polarization. This solution does not provide a possibility of electronic scanning as the antenna has large dimensions, low amplification in the longitudinal direction, and big losses in the dielectric material.

According to various embodiments of the present disclosure, there is provided a wireless communication device having an antenna array to obtain an effective radiation direction.

According to various embodiments of the present disclosure, there are also provided a configuration and a structure for slot antenna array elements in a communication device having a dielectric coating of a display that effectively radiates a signal in a direction indicated (oriented, end fire) by a housing.

Technical Solution

A wireless communication device according to various embodiments of the present disclosure includes a housing, a dielectric substrate fixed in the housing, and a dielectric cover on the dielectric substrate, in which the dielectric substrate includes a multi-layer printed circuit and a metal layer that covers a top surface of the multi-layer printed circuit, the metal layer includes a slot antenna array including multiple first slot elements having a first length and multiple second slot elements having a second length longer than the first length, one even-numbered slot element or multiple even-numbered slot elements of the multiple first slot elements are out of line with one odd-numbered slot element or multiple odd-numbered slot elements on the metal layer, and one even-numbered slot element or multiple even-numbered slot elements of the multiple second slot elements are out of line with the one odd-numbered slot element or the multiple odd-numbered slot elements on the metal layer.

An antenna for a wireless communication device according to various embodiments of the present disclosure includes a dielectric substrate including a multi-layer printed circuit and a metal layer that covers a top surface of the multi-layer printed circuit and a dielectric cover stacked on the metal layer included in the dielectric substrate, in which the metal layer includes a slot antenna array of pairs of multiple slot elements including at least two slot elements having different lengths, respectively, and one even-numbered pair or multiple even-numbered pairs among the pairs of the multiple slot elements are out of line with one odd-numbered slot element or multiple odd-numbered slot elements on the metal layer.

Advantageous Effects

According to various embodiments of the disclosure, it is possible to provide an antenna radiation pattern, increase a scanning range, and reduce signal loss, while increasing the radiation of a millimeter range antenna in a preset direction, thereby substantially improving communication performance.

MODE FOR CARRYING OUT THE INVENTION

Figure 1:
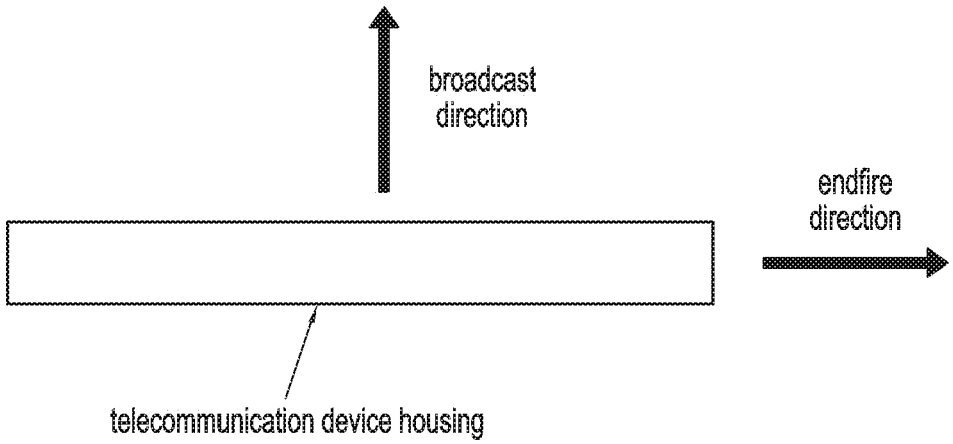
FIG. 1 shows radiation directions from an antenna of a communication device.

Hereinafter, various embodiments of the present disclosure will be disclosed with reference to the accompanying drawings. However, the description is not intended to limit the present disclosure to particular embodiments, and it should be construed as including various modifications, equivalents, and/or alternatives according to the embodiments of the present disclosure. With regard to the description of the drawings, similar reference numerals may be used to refer to similar or related elements.

In the present disclosure, an expression such as "having," or "may have," or "comprising," or "may comprise" indicates existence of a corresponding characteristic (e.g., a numerical value, a function, an operation, or an element like a part) and does not exclude existence of additional characteristic.

In the present disclosure, an expression such as "A or B," "at least one of A or/and B," or "one or more of A or/and B" may include all possible combinations of together listed items. For example, "A or B," "at least one of A and B," or "one or more of A or B" may indicate the entire of (1) including at least one A, (2) including at least one B, or (3) including both at least one A and at least one B.

Expressions such as "first," "second," "primarily," or "secondary," used in various embodiments may represent various elements regardless of order and/or importance and do not limit corresponding elements. The expressions may be used for distinguishing one element from another element. For example, a first user device and a second user device may represent different user devices regardless of order or importance. For example, a first element may be named as a second element without departing from the right scope of the various exemplary embodiments of the present disclosure, and similarly, a second element may be named as a first element.

When it is described that an element (such as a first element) is "operatively or communicatively coupled with/to" or "connected" to another element (such as a second element), the element can be directly connected to the other element or can be connected to the other element through another element (e.g., a third element). However, when it is described that an element (e.g., a first element) is "directly connected" or "directly coupled" to another element (e.g., a second element), it means that there is no intermediate element (e.g., a third element) between the element and the other element.

An expression "configured (or set) to" used in the present disclosure may be replaced with, for example, "suitable for," "having the capacity to," "designed to," "adapted to," "made to," or "capable of" according to a situation. A term "configured (or set) to" does not always mean only "specifically designed to" by hardware. Alternatively, in some situation, an expression "apparatus configured to" may mean that the apparatus "can" operate together with another apparatus or component. For example, a phrase "a processor configured (or set) to perform A, B, and C" may be a dedicated processor (e.g., an embedded processor) for performing a corresponding operation or a generic-purpose processor (such as a CPU or an application processor) that can perform a corresponding operation by executing at least one software program stored at a memory device.

Terms defined in the present disclosure are used for only describing a specific exemplary embodiment and may not have an intention to limit the scope of other exemplary embodiments. It is to be understood that a singular form of a noun corresponding to an item may include one or more of the things, unless the relevant context clearly indicates otherwise. All of the terms used herein including technical or scientific terms have the same meanings as those generally understood by an ordinary skilled person in the related art. The terms defined in a generally used dictionary should be interpreted as having meanings that are the same as or similar with the contextual meanings of the relevant technology and should not be interpreted as having ideal or exaggerated meanings unless they are clearly defined in the various exemplary embodiments. In some case, terms defined in the present disclosure cannot be analyzed to exclude the present exemplary embodiments.

Various embodiments proposed in the present disclosure may provide an antenna unit, which can be located in a housing of a communication device, including a housing with a metal frame, that provides operation according to 5G, WiGig standard, and others, and thereby providing coverage of the required signal propagation directions by an antenna array of the communication device. The signal propagation directions may include a broadside direction and an end-fire direction. The broadside direction is perpendicular to the plane of the communication device display, and the end-fire direction is parallel to the plane of a display of the communication device. That is, the broadside direction and the end-fire direction may have an angle of 90 degrees.

Various embodiments proposed in the present disclosure may provide improvement of the directional properties of the antenna and in some embodiments reduce the back radiation of the traveling wave antenna.

The antenna proposed by at least the preferred embodiment may provide:

reliable and stable signal reception even with the communication device having a metal frame;

high gain greater than 10 dB for 4 pairs of antenna elements;

low reflection loss (reflection coefficient of <−10 dB);

improved scanning range of +/−75 degrees;

reduction of radiation in the back endfire direction;

electrical isolation with other elements of the device due to the screened structure of the antenna array.

Hereinafter, various embodiments to be proposed will be described in detail with reference to the accompanying drawings.

FIG. 1 shows the radiation directions from the antenna of the communication device.

Referring to FIG. 1, one propagation wave or multiple propagation waves may be generated by a proposed configuration of slot antenna array elements. The generated one propagation wave or multiple propagation waves may propagate a dielectric cover and/or a dielectric substrate that encloses a metal frame of a communication device housing. One propagation wave or multiple propagation waves propagating through the dielectric cover and/or dielectric substrate may be emitted in a horizontal direction (an end-fire direction) along a plane of a display of a communication device or in a direction perpendicular to the plane of the display.

Figure 2:
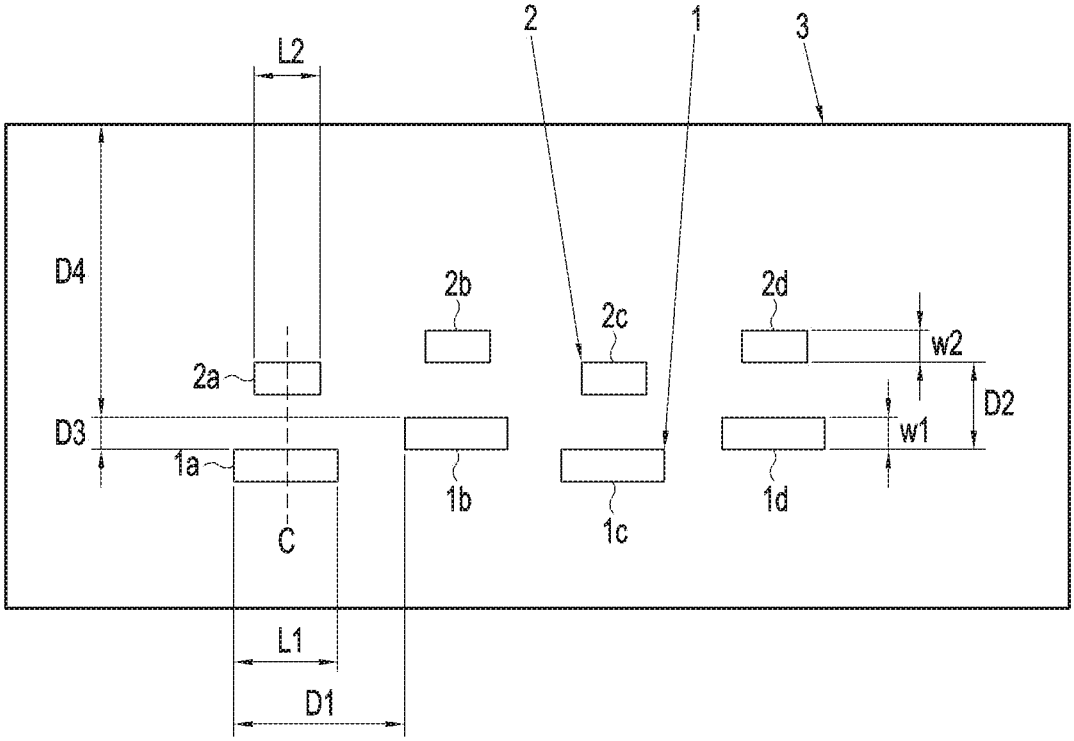
FIG. 2 shows an array of slot radiators of an antenna array in a top view of a communication device, according to various embodiments.

FIG. 2 shows an array of slot radiators of the antenna array in a top view of the communication device, according to various embodiments.

Referring to FIG. 2, a modification of the shown antenna array may include slot elements of each of multiple groups on or inside a dielectric substrate 3. Hereinbelow, it will be assumed that for convenience, slot elements of each of multiple groups are provided on the dielectric substrate 3. However, the proposed embodiments should not be limited to a case where the slot elements of each of the multiple groups are provided on the dielectric substrate 3. That is, in the proposed embodiments, the slot elements of each of the multiple groups may be provided inside the dielectric substrate 3, or some of the slot elements may be provided inside the dielectric substrate 3 and other some of the slot elements may be provided on the dielectric substrate 3.

According to an embodiment, slot elements of each of at least two groups (e.g., a first group 1 and a second group 2) may be provided on the dielectric substrate 3. For example, slot elements 1*a*, 1*b*, 1*c*, and 1*d* of the first group 1 and slot elements 2*a*, 2*b*, 2*c*, and 2*d* of the second group 2 may be provided on the dielectric substrate 3. The slot elements 1*a*, 1*b*, 1*c*, and 1*d* of the first group 1 and the slot elements 2*a*, 2*b*, 2*c*, and 2*d* of the second group 2 may be rectangular cutouts formed in a metal layer located on the dielectric substrate 3.

The slot elements 1*a*, 1*b*, 1*c*, and 1*d* of the first group 1 may have the same length L1 and the same width w1. The slot elements 2*a*, 2*b*, 2*c*, and 2*d* of the second group 2 may have the same length L2 and the same width w2. A length L may correspond to a dimension of a long side of a rectangular cutout corresponding to a slot element, and a width w may correspond to a dimension of a short side of the rectangular cutout corresponding to the slot element.

For example, the length L1 of the slot elements 1*a*, 1*b*, 1*c*, and 1*d* of the first group 1 and the length L2 of the slot elements 2*a*, 2*b*, 2*c*, and 2*d* of the second group 2 may be different from each other. For example, the length L1 of the slot elements 1*a*, 1*b*, 1*c*, and 1*d* of the first group 1 may be greater than the length L2 of the slot elements 2*a*, 2*b*, 2*c*, and 2*d* of the second group 2.

According to an embodiment, the slot elements 1*a*, 1*b*, 1*c*, and 1*d* of the first group 1 may be arranged on the dielectric substrate 3 in a vertical direction as defined below.

More specifically, odd-numbered slot elements 1*a* and 1*c* and even-numbered slot elements 1*b* and 1*d* among the slot elements 1*a*, 1*b*, 1*c*, and 1*d* of the first group 1 may be arranged in parallel to have different heights in the vertical direction. That is, the odd-numbered slot elements 1*a* and 1*c* of the first group 1 may be arranged in parallel to have the same height in the vertical direction, and the even-numbered slot elements 1*b* and 1*d* of the first group 1 may be arranged in parallel to have the same height in the vertical direction.

In this case, the odd-numbered slot elements 1*a* and 1*c* and the even-numbered slot elements 1*b* and 1*d* of the first group 1 may be arranged up-down-up-down alternately in the vertical direction. That is, an upper long side (or a lower long side) of the odd-numbered slot elements 1*a* and 1*c* of the first group 1 and a lower long side (or an upper long side) of the even-numbered slot elements 1*b* and 1*d* may have the same height or may be spaced apart by a specific distance in the vertical direction. A distance between the upper long side (or the lower long side) of the odd-numbered slot elements 1*a* and 1*c* of the first group 1 and the lower long side (or the upper long side) of the even-numbered slot elements 1*b* and 1*d*, when having the same height in the vertical direction, may be equal to the width w1 of the slot elements 1*a*, 1*b*, 1*c*, and 1*d* of the first group 1. The distance between the upper long side (or the lower long side) of the odd-numbered slot elements 1*a* and 1*c* of the first group 1 and the lower long side (or the upper long side) of the even-numbered slot elements 1*b* and 1*d*, when being spaced apart by the specific distance in the vertical direction, may have a specific value. The specific value may be greater than the width w1 of the slot elements 1*a*, 1*b*, 1*c*, and 1*d* of the first group 1.

According to an embodiment, the slot elements 1*a*, 1*b*, 1*c*, and 1*d* of the first group 1 may be arranged on the dielectric substrate 3 in a horizontal direction as defined below.

More specifically, each of the slot elements 1*a*, 1*b*, 1*c*, and 1*d* of the first group 1 may be arranged spaced apart from a next slot element by a distance D1 in a left-to-right direction (the horizontal direction). For example, a left short side (or a right short side) of the first slot element 1*a* of the first group 1 may be arranged spaced apart by the distance D1 from a right short side (or a left short side) of the second slot element 1*b* arranged next to the first slot element 1*a* in the horizontal direction. The distance D1 may be greater than the length L1 of the slot elements 1*a*, 1*b*, 1*c*, and 1*d* of the first group 1.

According to an embodiment, the slot elements 2*a*, 2*b*, 2*c*, and 2*d* of the first group 1 may be arranged on the dielectric substrate 3 in a vertical direction as defined below.

More specifically, odd-numbered slot elements 2*a* and 2*c* and even-numbered slot elements 2*b* and 2*d* among the slot elements 2*a*, 2*b*, 2*c*, and 2*d* of the second group 2 may be arranged in parallel to have different heights in the vertical direction. That is, the odd-numbered slot elements 2*a* and 2*c* of the first group 2 may be arranged in parallel to have the same height in the vertical direction, and the even-numbered slot elements 2*b* and 2*d* of the second group 2 may be arranged in parallel to have the same height in the vertical direction.

In this case, the odd-numbered slot elements 2*a* and 2*c* and the even-numbered slot elements 2*b* and 2*d* of the second group 2 may be arranged up-down-up-down alternately in the vertical direction. That is, an upper long side (or a lower long side) of the odd-numbered slot elements 2*a* and 2*c* of the second group 2 and a lower long side (or an upper long side) of the even-numbered slot elements 2*b* and 2*d* may have the same height or may be spaced apart by a specific distance in the vertical direction. A distance between the upper long side (or the lower long side) of the odd-numbered slot elements 2*a* and 2*c* of the second group 2 and the lower long side (or the upper long side) of the even-numbered slot elements 2*b* and 2*d*, when having the same height in the vertical direction, may be equal to the width w1 of the slot elements 2*a*, 2*b*, 2*c*, and 2*d* of the first group 2. The distance between the upper long side (or the lower long side) of the odd-numbered slot elements 2*a* and 2*c* of the second group 2 and the lower long side (or the upper long side) of the even-numbered slot elements 2*b* and 2*d*, when being spaced apart by the specific distance in the vertical direction, may have a specific value. The specific value may be greater than the width w2 of the slot elements 2*a*, 2*b*, 2*c*, and 2*d* of the second group 2.

According to an embodiment, the slot elements 2*a*, 2*b*, 2*c*, and 2*d* of the second group 2 may be arranged on the dielectric substrate 3 in a horizontal direction as defined below.

More specifically, each of the slot elements 2*a*, 2*b*, 2*c*, and 2*d* of the second group 2 may be arranged spaced apart from a next slot element by a distance (not shown) in the left-to-right direction (the horizontal direction). For example, a left short side (or a right short side) of the first slot element 2*a* of the first group 2 may be arranged spaced apart by the distance from a right short side (or a left short side) of the second slot element 2*b* arranged next to the first slot element 1*a* in the horizontal direction. The specific value may be greater than the length L2 of the slot elements 2*a*, 2*b*, 2*c*, and 2*d* of the first group 2.

According to an embodiment, the slot elements 1*a*, 1*b*, 1*c*, and 1*d* of the first group 1 and the slot elements 2*a*, 2*b*, 2*c*, and 2*d* of the second group 2 on the dielectric substrate 3 may have a relationship in the vertical direction as defined below.

More specifically, the odd-numbered elements 1*a* and 1*c* of the first group 1 and the odd-numbered elements 2*a* and 2*c* of the second group 2 may be arranged such that a lower (or upper) long side is spaced by a specific interval D2. The even-numbered elements 1*b* and 1*d* of the first group 1 and the even-numbered elements 2*b* and 2*d* of the second group 2 may be arranged such that a lower (or upper) long side is spaced by the specific interval D2. The interval D2 may be greater than the width 1 of the slot elements 1*a*, 1*b*, 1*c*, and 1*d* of the first group 1 or the width w2 of the slot elements 2*a*, 2*b*, 2*c*, and 2*d* of the second group 2.

According to an embodiment, the slot elements 1*a*, 1*b*, 1*c*, and 1*d* of the first group 1 and the slot elements 2*a*, 2*b*, 2*c*, and 2*d* of the second group 2 on the dielectric substrate 3 may have a relationship in the horizontal direction as defined below.

The slot elements 1*a*, 1*b*, 1*c*, and 1*d* of the first group 1 and the slot elements 2*a*, 2*b*, 2*c*, and 2*d* of the second group 2 may be arranged on the dielectric substrate 3, such that their long sides are parallel in the horizontal (left-right) direction in the figure. Herein, "parallel" in the horizontal direction may include not only parallel in the same height in the vertical direction (parallel on a straight line) but also parallel in different heights in the vertical direction (parallel maintaining level).

More specifically, the slot elements 1*a*, 1*b*, 1*c*, and 1*d* of the first group 1 and the slot elements 2*a*, 2*b*, 2*c*, and 2*d* of the second group 2 may be paired. For example, the first slot element 1*a* of the first group 1 and the first slot element 2*a* of the second group 2 may form a pair a, the second slot element 1*b* of the first group 1 and the second slot element 2*b* of the second group 2 may form a pair b, the third slot element 1*c* of the first group 1 and the third slot element 2*c* of the second group 2 may form a pair c, and the fourth slot element 1*d* of the first group 1 and the fourth slot element 2*d* of the second group 2 may form a pair d.

The paired slot elements of the first group 1 and the second group 2 may be arranged on or inside the dielectric substrate 3 to face each other in the up-down direction in the figure.

The paired slot elements of the first group 1 and the second group 2 may be arranged on the dielectric substrate, such that central axes of the slot elements of the first group 1 and the second group 2 are aligned in line. In this case, a central axis C of each of the slot elements 1*a*, 1*b*, 1*c*, and 1*d* of the first group 1 and the slot elements 2*a*, 2*b*, 2*c*, and 2*d* of the second group 2 may be perpendicular to long sides of the corresponding slot element.

For example, for the first pair a of the first slot element 1*a* of the first group 1 and the first slot element 2*a* of the second group 2, the central axis of the first slot element 1*a* of the first group 1 and the central axis of the first slot element 2*a* of the second group 2 may be aligned in line in the up-down direction (see C). In this case, the central axis C may halve the long side of the first slot element 1*a* of the first group 1 and the long side of the first slot element 2*a* of the second group 2.

A structure according to the above-described example may be equally applied to other pairs (pairs of the other slot elements 1*b*, 1*c*, and 1*d* of the first group 1 and the other slot elements 2*b*, 2*c*, and 2*d* of the second group 2).

In this case, a distance between the central axes of the pairs may be equal to D1 defined above. The multiple pairs a, b, c, and d of the slot elements 1*a*, 1*b*, 1*c*, and 1*d* of the first group 1 and the slot elements 2*a*, 2*b*, 2*c*, and 2*d* of the second group 2 may be arranged on the dielectric substrate 3 in the left-right direction in the figure. That is, a central axis of each of the multiple pairs a, b, c, and d may be arranged on the dielectric substrate 3 to be parallel to each other in the left-right direction in the figure.

According to the above description, a phase difference between signals emitted from slot elements of each of pairs arranged on the dielectric substrate 3 may be 90 degrees. That is, a first signal emitted from the slot element of the first group 1 and a second signal emitted from the slot element of the second group 2 out of one pair may have a phase difference of 90 degrees.

In this case, the different lengths of the slots provide an effective slope of the radiation beam along the aperture of the slot and, as a result, provide total radiation of the antenna in the desired endfire direction.

The slot elements 1*a*, 1*b*, 1*c*, and 1*d* of the first group 1 and the slot elements 2*a*, 2*b*, 2*c*, and 2*d* of the second group 2 may be located on the dielectric substrate 3 or in the dielectric substrate 3, for example, they may be cut out in a metal layer located on the dielectric substrate 3 or inside the dielectric substrate 3.

The length (L1, L2) and the width (w1, w2) of the slots, in accordance with the general theory of slot antennas, are determined by the expressions:

$$\lambda_{eff}/2<L2<L1<\lambda_{eff},$$

$$w1,w2\sim(0.1-0.3)\lambda_{eff}, \quad \text{Equation 1}$$

wherein, w1, w2~(0.1–0.3)$\lambda_{eff}$, where $\lambda_{eff}$ is the effective wavelength translated for an equivalent material with an averaged dielectric constant $$\varepsilon_{eff}\left(\varepsilon_{eff}=\frac{\varepsilon 1*h1+\varepsilon 2*h2}{h1+h2}\right)$$

and defined by the thickness of the dielectric substrate h1 material and the thickness of the dielectric coating h2 material:

The distance between the pairs of slots (D1 in FIG. 2) may be defined as a distance from the short side of one pair of slot elements to the corresponding short side of the adjacent pair of slot elements. According to the general theory of antenna arrays, the distance may be calculated by:

$$\lambda_1/2<D1<\lambda_1 \quad \text{Equation 2}$$

where $\lambda_1$ is the wavelength in the dielectric substrate.

The distance D1 between the slot elements in each pair may be defined as a distance from one long side of the slot element of the first group to the corresponding long side of the slot element of the second or subsequent group. In this case, D1 is approximately equal to one quarter of the wavelength.

This arrangement provides a phase shift of radiation of these antenna slot elements by 90 degrees. If there are more than two groups of slot elements, that is, when a subsequent slot element(s) is (are) added to the pair of slot elements, likewise, the distance between each adjacent slot elements should provide a phase shift of radiation of these antenna slot elements by 90 degrees.

The arrangement of pairs of antenna slot elements is out of line and non-linear. That is, the adjacent pairs of antenna slot elements are not arranged along a common axis. For example, even pairs of the slot elements can be arranged in one row, odd pairs of the slot elements—in another row. In this case, the long sides of all the slots are parallel, and the lateral sides of the adjacent pairs of the slot elements face each other. However, the pairs are located not along the same axis. That is, the even pairs are offset relative to the adjacent odd pairs by a distance D3 equal to the distance between the respective long sides of the slots of the even and odd pair. The value of offset D3 is approximately equal to one tenth of the wavelength in order to suppress propagation of parasitic waves along the metal casing.

The distance D4, defined as a distance from the edge of the dielectric substrate, which can correspond to the position of the metal frame of the communication device housing, to the long side of the slot element nearest to this edge, is approximately a multiple of $\lambda_{eff}/2$. D4 may be determined by the objectives of minimizing the reflection of electromagnetic waves propagating in the dielectric coating, from the metal case.

Figure 3:
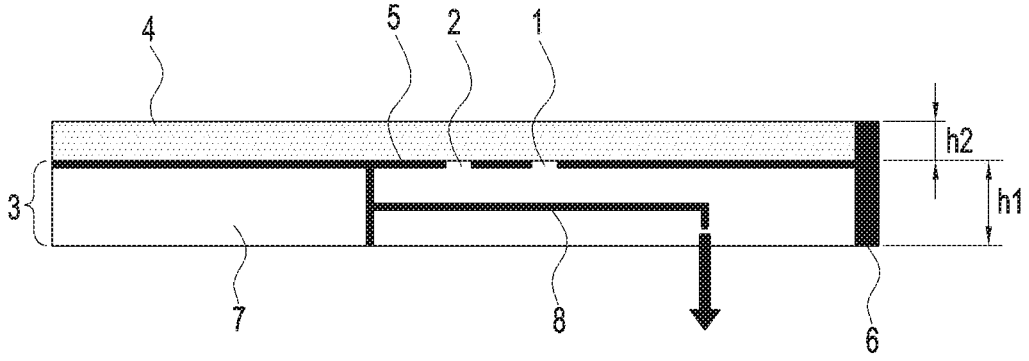
FIG. 3 is a side view of the communication device with an antenna array, according to various embodiments.

FIG. 3 is a side view of the communication device with an antenna array, according to various embodiments.

Referring to FIG. 3, the communication device may include a dielectric substrate 3, for example, a multilayer printed circuit board 7 covered with a metal layer 5. On the dielectric substrate 3, there is dielectric coating—a dielectric screen of the display 4 of the communication device.

Groups of slots formed in the metal layer 5 (the slot element of the first group and the slot element of the second group) are supplied with a signal via a signal feedline 8, which in one embodiment is a microstrip line. One peculiarity of operation of the proposed antenna unit is that the metal frame 6 of the communication device is not an obstacle to the traveling wave generated by the antenna unit.

Each pair of antenna slot elements consists of at least two slot antenna elements 1 and 2 of the first and second groups. But if there are additional groups of the slot elements, for example, third, fourth, etc., subsequent slot elements related to said additional groups can be added to the pairs of the slot elements. In this case, the pair will include not only slot elements of the first and second groups, but also the additional slot elements of the third and subsequent groups.

Each slot antenna element of a pair is sequentially excited by a traveling wave passing through the feeding microstrip line. For maximum radiation, the first slot is located at a distance equal to approximately half the wavelength propagating in the dielectric substrate from the short-circuit to the ground of the feedline.

The second and subsequent slots, if present, shall be located at such a distance from the first (or previous) slot along the feedline that the phase shift between the waves they radiate is 90 degrees.

The length of each slot is from half the wavelength to one wavelength, wherein one slot in the pair is shorter in length than the other slot, similar to the principle realized in "wave channel" antennas in which a shorter radiator is the director for a longer radiator.

The presence of a dielectric display screen with a greater dielectric permittivity than that of the substrate above the slot antenna elements of the communication device provides for better direction of radiation in the end-fire direction.

The dielectric display screen is a delay line for the slot antenna elements, and it holds the surface waves in the dielectric and prevents premature radiation in the broadside direction, which improves directional properties of the traveling wave radiated by the slot antenna array and increases directivity and overall gain of the antenna array.

The slot antenna array elements are misaligned. That is, the adjacent slot elements of the first and second groups and the adjacent even and odd pairs of the slot elements are offset relative to each other such that the distance from the edge of the dielectric substrate to the even and odd pairs is different. This arrangement allows suppressing propagation of parasitic waves along the metal housing, which appears as a result of in-phase reflection from the housing. A small phase shift of approximately one-tenth of the wavelength eliminates the phasing-in of the reflected surface waves and increases the antenna array gain.

The slot elements of the antenna array excite the surface waves in the dielectric coating. This makes it possible to provide output of radiation transmitted by these waves through the metal frame of the communication device or other metal obstacles that may be in the housing of the communication device.

With such a solution, a small parasitic radiation may be present in the direction opposite to the main direction of radiation. To suppress this parasitic radiation, passive reflecting slot elements 9*a*-1, 9*a*-2, 9*b*-1, 9*b*-2, 9*c*-1, 9*c*-2, 9*d*-1, and 9*d*-2 are used which are located behind the radiating slots 1*a*, 1*b*, 1*c*, and 1*d* on the side opposite the main direct radiation direction (the gray arrow in FIG. 4).

These passive reflecting slots 9a-1, 9a-2, 9b-1, 9b-2, 9c-1, 9c-2, 9d-1, and 9d-2 reflect surface waves propagating in the dielectric.

For their effective operation, these passive reflecting slots 9a-1, 9a-2, 9b-1, 9b-2, 9c-1, 9c-2, 9d-1, and 9d-2 are located at a distance of about $1_2/4$-$1^2/2$ from the radiating slot elements, providing an antiphase addition of forward and backward waves. $1_2$ is the wavelength in the dielectric coating. The length of the reflecting slots, also similar to the principle of "wave channel" antennas, is somewhat larger than the length of the main radiating slots.

The reflecting slots, having an inductive impedance nature, are "reflectors" for radiating slots. The width of the passive reflective slots is approximately equal to the width of the radiating slots w1, w2. In general, one reflecting slot can be used for each antenna array element, but dividing them into several slots (for example, using a pair of the reflecting slots the long sides of which are located on the same line parallel to the long sides of radiating slot elements in the pair) allows further suppression of the phasing-in of the inverse radiation. Such a solution allows substantially suppressing parasitic radiation in the back end-fire direction and increasing the directional properties in the forward end-fire direction.

Figure 4:
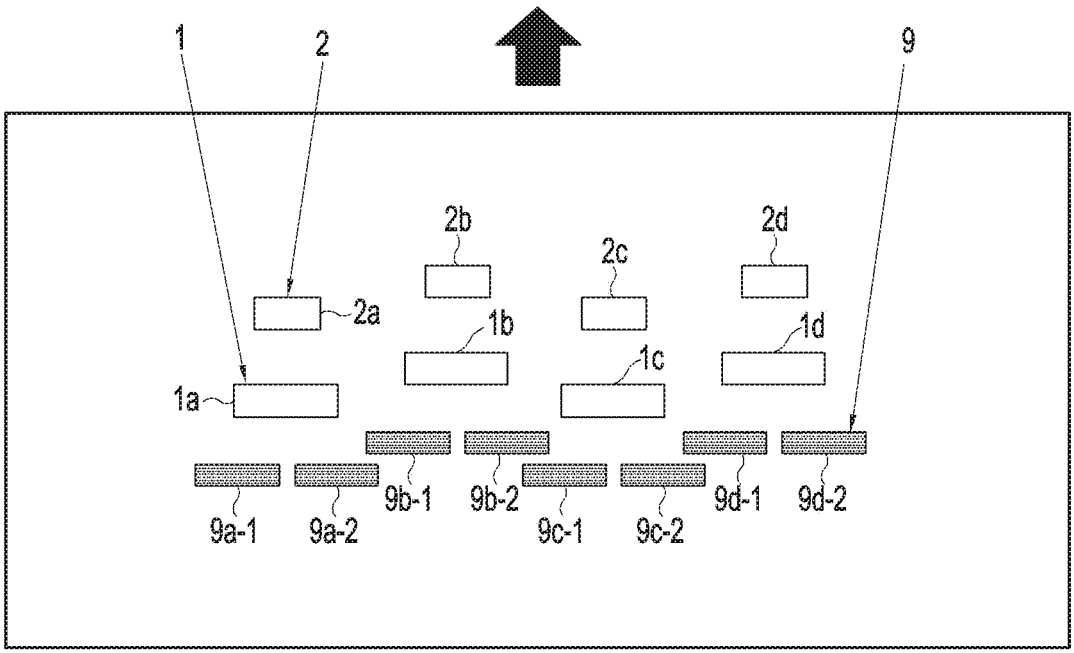
FIG. 4 shows implementation of passive reflecting slots in a communication device, according to proposed various embodiments.

FIG. 4 shows implementation of passive reflecting slots in a communication device, according to proposed various embodiments.

Referring to FIG. 4, each pair of radiating slot elements can be associated with two passive reflecting slot elements arranged symmetrically about the central axis of each pair of radiating slot elements such that the long sides of the passive reflective slot elements are parallel to the long sides of the radiating slot elements.

Figure 5:
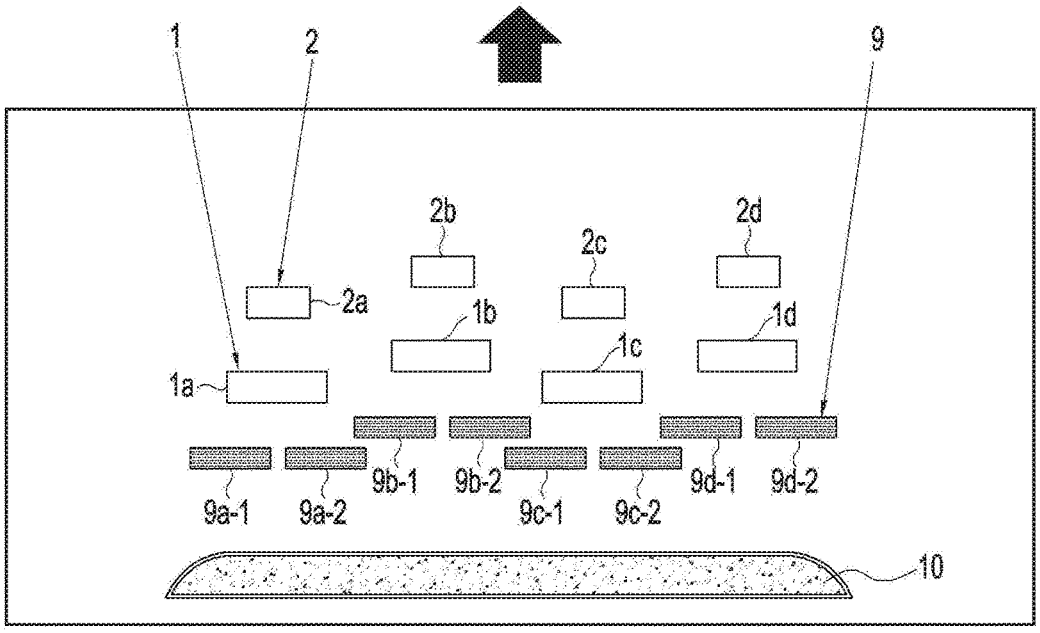
FIG. 5 shows implementation of a slot antenna array and passive reflecting slots in combination with a metal reflecting screen for a case when an antenna is located below a back cover of a device, according to proposed various embodiments.

FIG. 5 shows implementation of a slot antenna array and passive reflecting slots in combination with a metal reflecting screen for a case when an antenna is located below a back cover of a device, according to proposed various embodiments.

Referring to FIG. 5, not only passive reflecting slots 9a-1, 9a-2, 9b-1, 9b-2, 9c-1, 9c-2, 9d-1, and 9d-2, but also a metal reflecting screen 10 can be used as a reflecting element individually or in combination.

For example, a metal wall 10 may be used as a reflecting element, which is located at a distance slightly greater than half the length of the traveling wave in the dielectric, since it reflects part of the radiation propagating in the free space. That is, the metallic reflecting screen function can be performed by a metal wall 10 of a camera built into the communication device located in the plane of the antenna array for the case where the antenna array is located under the back cover of the device, the dielectric parameters of which satisfy the following parameters of the waveguide structure.

Figure 6:
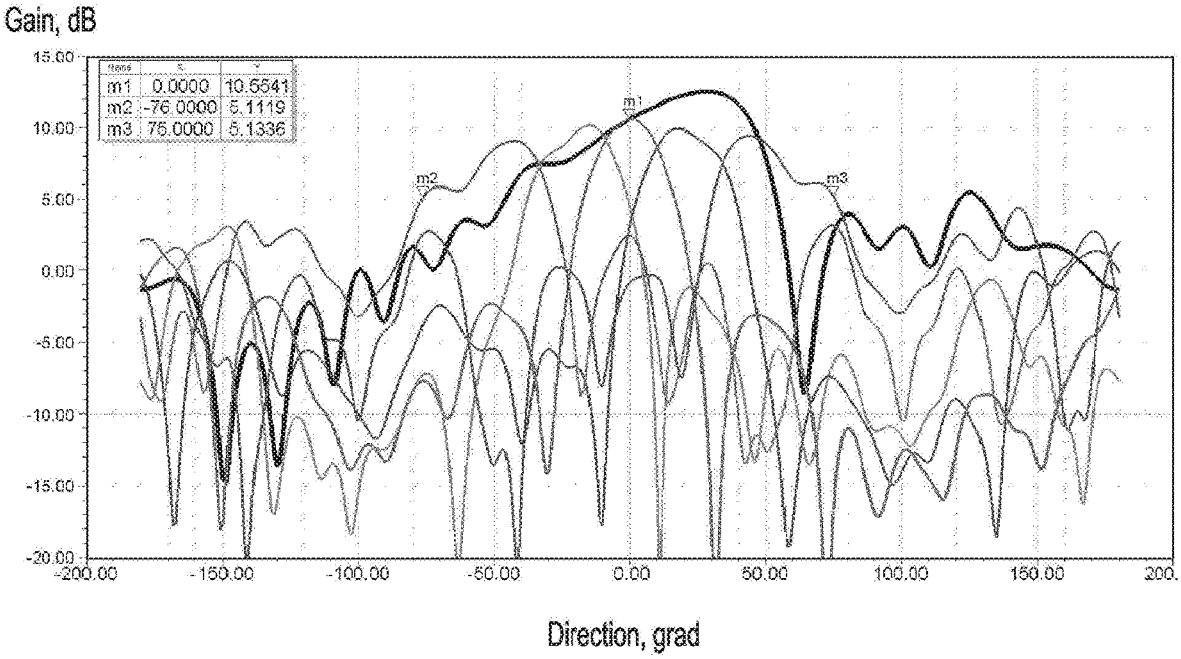
FIG. 6 shows a graph of a gain versus radiation direction in an antenna unit, according to proposed various embodiments.

FIG. 6 shows a graph of a gain versus radiation direction in an antenna unit, according to proposed various embodiments. That is, FIG. 6 shows a simulation result of an antenna unit operation according to a proposal of various disclosures.

Referring to FIG. 6, a thick black line shows the graph of the proposed antenna unit gain versus radiation direction, the point m1 corresponds to the endfire direction of radiation. The scanning range is provided from point m2 to point m3 and is 150 degrees (+/−75 degrees).

The proposed antenna unit can be implemented on or in a dielectric multi-layer printed circuit board, with subsequent tight connection to the display (for example, with glue). The connection parameters are also taken into account in a calculation model (for example, the thickness and dielectric characteristics of the adhesive joint are taken into account).

Since the material of the dielectric display screen has a greater dielectric permeability than the material of the dielectric substrate which accommodates the antenna elements, it is a slowing structure for electromagnetic waves excited by the antenna array. Therefore, since the conditions that define the display as a dielectric waveguide (mainly parameters of the dielectric constant and the display height) are observed for the display, it is possible to direct electromagnetic waves in the endfire direction in the structure of the dielectric display and to reduce radiation in the broadside direction.

The proposed solution provides the possibility of efficient use of a millimeter-wave antenna embedded in communication devices and other communication devices having a metal casing or a metal casing frame.

A communication device capable of wireless communication and having the claimed antenna unit can be any mobile communication device such as a mobile phone, a tablet computer adapted to perform wireless communication, a laptop, an ultrabook, a PDA, a display device capable of wireless communication, or any other device having a display and the capability of adopting an antenna array in a communication device housing.

The antenna unit may be built into the communication unit of the communication device. Functionally, the communication unit of the communication device includes a radiation source, a power supply unit, a data output unit, a user input unit, and other units necessary for realization of its purpose. The radiation source transmits and receives the user input signals, and it includes the data converters for converting data received from the user into signals suitable for transmission to the appropriate receiving apparatus. The data output unit may, in particular, include a display, showing the data necessary for communication to the user, and a loudspeaker. The user input unit may include a microphone, a keyboard, a display and any other unit suitable for receiving data from the user and direction of data to the communication unit. The power supply unit supplies power for operation of the aforementioned units.

Through the use of the inventive traveling wave antenna, the wave envelops the metal housing of the communication thereby permitting radiation in the end-fire direction. This avoids the need in any ports or discontinuities in the metal housing that would impair integrity of the housing.

The inventive structure of the antenna unit and the communication device including the same has the following advantages:

a high-gain antenna; and improved scanning in the end-fire direction within the range of +/−75, the extension of the scanning sector is connected with the slowing properties of the dielectric cover for the waves excited by the antenna emitter.

The features of the inventive antenna provide improvement of directional properties of the traveling wave antenna in the end-fire direction by supporting the surface waves and enhancement of beam scanning of the radiation pattern in the longitudinal plane without scanning losses due to electromagnetic wave propagating in the dielectric cover.

The metal frame of the communication device housing is used for matching the antenna unit with the external environment. Using a traveling wave allows radiation to envelop the metal frame and effectively propagate in the end-fire direction.

The embodiments proposed in the disclosure are not limited to those demonstrated above.

As explained above, the proposed antenna unit includes a dielectric cover, for example, a printed circuit board on or inside which an array of slot antenna elements for generation of a traveling wave is formed, excited by a microstrip line formed in the printed circuit board.

Each slot element of antenna array excites traveling waves, which are propagating in the dielectric display screen and in the dielectric cover, and then the radiation, enveloping the metal frame of the housing, is emitted towards the base station.

The traveling wave antenna with the wave propagating in the dielectric has a large reactive component of the output resistance and shall be consistent with the external environment.

The metal elements, such as a metal frame of the device housing on the end of the dielectric, are used for effective compensation of this reactive component of the output impedance and for providing directional radiation into the external environment. In general, the very existence of a "step" of the metal object will be introduction of matching reactivity. For values greater than ⅛ (in air), the thickness of the metal housing frame ceases to exert strong influence. However, with smaller values, when this parameter can be varied by the manufacturer, it may also be considered in the optimization analysis.

The dielectric materials of the cover and the substrate may have a different ratio of dielectric permittivity characteristics. For example, if the dielectric permittivity of the cover is equal to $\varepsilon_1$, and the dielectric permittivity of the substrate dielectric is equal to $\varepsilon_2$, there may be different ratios ($\varepsilon_1>\varepsilon_2$, $\varepsilon_1<\varepsilon_2$ or $\varepsilon_1=\varepsilon_2$).

In various embodiments proposed in the present disclosure, the dielectric display screen, which can be either glass or any other dielectric material, shall have dielectric permittivity $\varepsilon_1$, which is greater than the dielectric permittivity $\varepsilon_2$ of the substrate dielectric, which accommodates the antenna. With such a ratio the slowing effect of the dielectric display is realized in various embodiments proposed in the present disclosure, which allows holding the electromagnetic waves in the thickness of the dielectric display screen and reduces premature emission of waves in the broadside direction.

In one embodiment, the described antenna array can be located under the back cover of the communication device if its dielectric permittivity is greater than that of the substrate dielectric and it satisfies the conditions of the slowing waveguide structure, as it was defined for the dielectric display screen.

In one of the embodiments, the implemented communication device has an "Edge" formed housing. That is, it includes a display with rounded edges. Such embodiment also ensures functioning of the inventive device as described above and provides achievement of the same advantageous effects that individually and collectively provide better communication of the communication device with the base station.

If the communication device does not have a metal frame or the metal frame is well below the location of the antenna elements and the bottom surface of the display (>¼-½), then free space matching reactivity can be administered in other ways, for example using matching stubs, etc.

The embodiments are not limited to those described herein, and a person skilled in the art based on the information contained herein and the knowledge in the art will appreciate other embodiments not departing from the spirit and scope of the invention.

The elements referred to in the singular do not exclude a plurality of the elements, unless specifically stated otherwise.

The functional connection of the elements should be understood as the connection that ensures the correct interaction of these elements with each other and implementation of functionality of the elements. Specific examples of the functional connection may be connection with the possibility of data exchange, connection with the possibility of transmitting an electric current, connection with the possibility of mechanical movement, connection with the possibility of transmission of light, sound, electro-magnetic or mechanical vibrations, etc. The specific type of the functional connection is determined by interaction of said elements, and, unless otherwise specified, is provided by well-known means, using the principles well-known in the art.

The present disclosure does not describe any specific software and hardware for implementing the blocks in the figures, but a person skilled in the art will appreciate that the essence of the disclosure is not limited to a particular hardware or software implementation, and therefore, any hardware or software means known in the art may be used for implementing the disclosure. Thus, hardware can be implemented within one or more application specific integrated circuits (ASIC), digital signal processors (DSP), DSP devices, programmable logic devices, field programmable gate arrays (FPGA), processors, controllers, microcontrollers, microprocessors, electronic devices, other electronic modules configured to perform the functions described herein, a computer, or a combination thereof.

Features mentioned in as sub concepts in various embodiments and the embodiments disclosed in the various parts of the description can be combined to achieve advantageous effects (even if the possibility of such a combination is not explicitly disclosed).

Any numerical values indicated in the materials of the present description or in the figures are intended to include all values from the lower value to the upper value of the mentioned ranges.

Despite the fact that the exemplary embodiments have been described in details and illustrated in the accompanying drawings, it should be understood that such embodiments are merely illustrative and are not intended to limit the broader invention, and that the present invention should not be limited to the specific illustrated and described layouts and designs, since various other modifications will be apparent to those skilled in the art.

Meanwhile, a detailed embodiment has been provided in the detailed description of the present disclosure, but those of ordinary skill in the art may also carry out various modifications without departing from the range of various embodiments proposed in the present disclosure. Therefore, the scope of the present disclosure should be defined by the appended claims and equivalents thereof, rather than by the described embodiments. Moreover, such modified embodiments should not be understood separately from the technical spirit or prospect of the present disclosure.

The invention claimed is:

1. A wireless communication device comprising:

a housing;

a dielectric substrate fixed in the housing; and a dielectric cover on the dielectric substrate, wherein the dielectric substrate comprises a multi-layer printed circuit and a metal layer that covers a top surface of the multi-layer printed circuit, wherein the metal layer comprises a slot antenna array comprising multiple first slot elements having a first length and multiple second slot elements having a second length longer than the first length, wherein one or more even-numbered slot elements of the multiple first slot elements are out of line with one or more odd-numbered slot elements of the multiple first slot elements on the metal layer, and wherein one or more even-numbered slot elements of the multiple second slot elements are out of line with one or more odd-numbered slot elements of the multiple second slot elements on the metal layer.

2. The wireless communication device of claim 1, wherein each of the multiple first slot elements is configured in the same radiation direction to have a phase shift of 90 degrees with one of the multiple second slot elements.

3. The wireless communication device of claim 1, wherein the housing further comprises a metal frame configured to additionally match waves propagating in the dielectric cover with an external environment.

4. The wireless communication device of claim 1, wherein a length of each of the multiple first slot elements or each of the multiple second slot elements is selected in a range from ½ of a wavelength of a propagation wave to the wavelength of the propagation wave.

5. The wireless communication device of claim 1, wherein even-numbered first and second slot elements are offset by 1/10 of a wavelength of a propagation wave for odd-numbered first and second slot elements.

6. The wireless communication device of claim 1, wherein passive reflecting slots are further provided in the metal layer to reflect a backward radiation wave.

7. The wireless communication device of claim 1, wherein a metal screen is further provided in the metal layer for back scattering.

8. An antenna for a wireless communication device, the antenna comprising:

a dielectric substrate comprising a multi-layer printed circuit and a metal layer that covers a top surface of the multi-layer printed circuit; and a dielectric cover stacked on the metal layer included in the dielectric substrate, wherein the metal layer comprises a slot antenna array of multiple pairs of slot elements comprising at least two slot elements having different lengths, respectively, and wherein one or more even-numbered multiple pairs of the slot elements are out of line with one or more odd-numbered multiple pairs of the slot elements on the metal layer.

9. The antenna of claim 8, wherein the multiple pairs of the slot elements comprise a first slot element and a second slot element that are provided in the same radiation direction to have a phase shift of 90 degrees.

10. The antenna of claim 8, wherein the housing further comprises a metal frame configured to additionally match waves propagating in the dielectric cover.

11. The antenna of claim 8, wherein a length of each of the at least two slot elements are selected differently in a range from ½ of a wavelength of a propagation wave to the wavelength of the propagation wave.

12. The antenna of claim 8, wherein the one or more even-numbered multiple pairs of the slot elements are offset by 1/10 of a wavelength of a propagation wave for the one or more odd-numbered multiple pairs of the slot elements on the metal layer.

13. The antenna of claim 8, wherein the slot antenna array further comprises passive reflecting slot elements configured to reflect backward radiation waves.

14. The antenna of claim 8, wherein the slot antenna array further comprises a metal screen for back scattering.

* * * * *